US005809717A

United States Patent [19]

Scarborough et al.

[11] Patent Number: 5,809,717

[45] Date of Patent: Sep. 22, 1998

[54] APPARATUS AND METHOD FOR ASSEMBLING COMPOSITE BUILDING PANELS

[75] Inventors: Walter W. Scarborough, Houston, Tex.; Michael L. McGraw, Ft. Lauderdale, Fla.

[73] Assignee: sequoyah eXo systems, Inc., Houston, Tex.

[21] Appl. No.: 601,793

[22] Filed: Feb. 15, 1996

[51] Int. Cl.[6] ..... E04B 1/00

[52] U.S. Cl. ..... 52/281; 52/282.1; 52/586.1; 52/591.1

[58] Field of Search ..... 52/281, 282.1, 52/282.4, 282.5, 586.1, 586.2, 589.1, 591.1, 437, 438, 309.12

[56] References Cited

U.S. PATENT DOCUMENTS

| | | | |
|---|---|---|---|
| 3,329,750 | 7/1967 | Growald | 264/45 |
| 3,738,083 | 6/1973 | Shimano | 52/282.1 X |
| 3,922,413 | 11/1975 | Reineman | 428/119 |
| 3,949,144 | 4/1976 | Duff | 428/414 |
| 3,982,367 | 9/1976 | Jonsson et al. | 52/309 |
| 4,006,574 | 2/1977 | Stolz | 52/438 |
| 4,019,296 | 4/1977 | Jochmann | 52/268 |
| 4,067,164 | 1/1978 | McMillan | 52/309.12 |
| 4,140,824 | 2/1979 | Gaillard | 428/81 |
| 4,253,288 | 3/1981 | Chun | 52/454 |
| 4,295,304 | 10/1981 | Kim | 52/90 |
| 4,342,180 | 8/1982 | Gibson et al. | 52/741 |
| 4,435,934 | 3/1984 | Kim | 52/309.7 |
| 4,486,993 | 12/1984 | Graham et al. | 52/262 |
| 4,677,800 | 7/1987 | Roodvoets | 52/309.12 |
| 4,774,794 | 10/1988 | Grieb | 52/309.7 |
| 4,788,803 | 12/1988 | Seitz | 52/82 |
| 4,823,534 | 4/1989 | Hebinck | 52/743 |
| 4,944,127 | 7/1990 | Clear | 52/309.12 |
| 4,975,396 | 12/1990 | Thiery | 501/90 |
| 5,081,810 | 1/1992 | Emmert | 52/221 |
| 5,086,599 | 2/1992 | Meyerson | 52/309.9 |
| 5,138,812 | 8/1992 | Palmersten | 52/584 |
| 5,181,353 | 1/1993 | Harrington, Jr. | 52/79.1 |
| 5,189,856 | 3/1993 | Windstrup | 52/309.9 |
| 5,247,770 | 9/1993 | Ting | 52/309.9 |
| 5,325,649 | 7/1994 | Kajiwara | 52/586.1 |
| 5,349,796 | 9/1994 | Meyerson | 52/309.11 |
| 5,373,678 | 12/1994 | Hesser | 52/592.1 |
| 5,381,638 | 1/1995 | Anderson | 52/592.1 |
| 5,497,589 | 3/1996 | Porter | 52/309.7 |
| 5,502,939 | 4/1996 | Zadok et al. | 52/309.9 |
| 5,509,242 | 4/1996 | Rechsteiner et al. | 52/270 |
| 5,519,971 | 5/1996 | Ramirez | 52/220.2 |
| 5,533,312 | 7/1996 | Mihalcheon | 52/309.9 |
| 5,613,338 | 3/1997 | Esposito | 52/588.1 |
| 5,628,158 | 5/1997 | Porter | 52/309.9 |

FOREIGN PATENT DOCUMENTS

| | | | |
|---|---|---|---|
| 1333730 | 6/1963 | France . | |
| 2332401 | 6/1977 | France | 52/282.1 |
| 2747637 | 11/1978 | Germany | 52/281 |

OTHER PUBLICATIONS

Product Brochure, *Foam Lock,* by Pratt & Lambert Specialty Products, (date not shown).

Product Brochure, *Enerbond DW,* by Abisko Manufacturing Inc., (date not shown).

Product Brochure, *Amhome,* by Amhome USA, Inc., (date not shown).

*Primary Examiner*—Creighton Smith

*Attorney, Agent, or Firm*—Vaden, Eickenroht & Thompson, L.L.P.

[57] ABSTRACT

An apparatus and method are provided for connecting the edges of two panels of EPS each of which has a groove therein. The apparatus and method contemplate the use of a tensile connector having tongue means and groove means. Means are provided for attaching the tongue means within the groove in one of the panels of EPS and attaching the groove means within the groove of the other panel of EPS. Means are provided for locking the tongue means within the groove means when the grooved edges of the panels are assembled to frame a hollow connection between the panels. The hollow connection filled with concrete to complete the connection between the EPS panels such that tensile forces applied to one of the panels are distributed across the tensile connector to the other panel. The invention is applicable to a plurality of EPS panels for interconnecting the panels to form the walls, ceiling, and roof of a building.

19 Claims, 10 Drawing Sheets

APPARATUS AND METHOD FOR ASSEMBLING COMPOSITE BUILDING PANELS

BACKGROUND OF THE INVENTION

1. Field of the Invention

This invention relates to building materials and, more particularly, to composite building panels formed of an expanded polymeric foam base and coated with a cementitious shell.

2. The Related Art

Shelter is one of man's necessities. From its earliest days, mankind has constantly striven to find protection from the hostile forces of the environment. As the world's population continues to expand and more people move to densely populated areas, the need for new housing has become a growing and serious problem. This increased demand coupled with the escalating cost of energy has created the challenge of providing shelter that is both affordable to build as well as to heat and cool, and that is less of a burden on the environment.

A system has been developed for fabricating structures from a composite building material, which includes building panels formed of an expanded polystyrene (EPS) foam base and coated with an outer cementitious shell, such as concrete. The use of composite building materials is generally known in the art. For example, U.S. Pat. No. 4,944,127 discloses the use of longitudinal grooves in a foam layer to increase the bonding characteristics between the foam layer and a cementitious layer in a building panel. Also, U.S. Pat. No. 5,189,856 describes the use of EPS blocks cut into ornamental shapes and sprayed with a cementitious layer to produce an ornamental construction material.

It is proposed herein to utilize a novel composite building panel in a load-bearing, or structural capacity, in addition to ornamental applications. One particular problem with structures or buildings constructed with assemblies of such composite panels is their vulnerability to external loads and forces. Composite panel structures are particularly vulnerable to tensile forces applied across the joints between the panels. Tensile forces are transmitted to structures through the application of forces in the plane of the panels or at angles to the plane of the panels, such as from impacts to the structure, ground tremors or earthquakes, and external pressure differentials acting across the walls or roof of a building such as from hurricane force winds. Such tensile forces can damage the panel assembly and, in extreme cases, tear apart the connected panels and cause catastrophic failures in buildings. Currently known composite panels in the art have failed to address this problem or propose a solution to it.

It is therefore an objective of the present invention to provide a very strong assembly of composite building panels connected with integral tensile connectors for use in constructing the foundations, floors, walls, ceilings, and roofs of buildings to withstand the application of substantial tensile forces across the panel connections.

It is well known in the building construction art to use framing members, or "studs," made of wood to provide a structural frame for hanging panels of wood or sheets of wall board, and for supporting the weight of a ceiling and roof. Non-load-bearing metal studs have long been used for the interior walls of commercial building suites because the ceilings in such suites are typically suspending by a wire assembly so that the walls may be easily assembled and disassembled, and the walls are not required to bear any loads.

Recently, in response to the rising costs of raw lumber, new home construction has begun to utilize metal studs in a load-bearing capacity. One problem with the liberal use of metal studs is the high coefficient of thermal expansion of metal, and the resulting thermal expansion and contraction that is experienced by the metal studs during seasonal temperature swings. This problem is critical in the application of such metal studs to composite building panels, such as those made of EPS, because EPS does not expand or contract in the presence of temperature changes. Therefore, repeated cycles of expansion and contraction by the metal studs during such temperature changes can cause unbalanced stresses in the EPS resulting in cracks in the panels. When such cracks develop and propagate, the integrity and load-bearing capabilities of a wall constructed of EPS panels is severely compromised.

It is therefore a further object of this invention to provide an assembly of composite building panels wherein all metal components including wall studs are completely surrounded and thereby insulated from temperature changes by EPS foam.

Another problem with the use of metal studs is their vulnerability to oxidation and other corrosive reactions, particularly in coastal areas having a high salinity content in the air.

It is therefore a further object of the present invention to isolate all metal components including wall studs from the ambient air to a greater extent than previously known by completely encasing the studs in EPS foam and sealing the metal components within a concrete mixture.

It is a further object of the present invention to provide a tensile connector for connecting the edges of adjacent EPS panels that can be easily incorporated in the composite building panel assemblies of this invention without sacrificing the light weight of the panels.

It is a further object of the present invention to provide EPS panels fabricated with the tensile connector of the present invention that can be easily and quickly assembled in the field to form the foundations, floors, walls, ceilings, and roofs of a building without the need for specialized tools.

Finally, it is an object of this invention to provide a very strong, durable, and energy efficient building constructed of the EPS building panels and tensile connectors of this invention that is suitable for extended habitation in extreme temperature conditions, corrosive environments, and strong winds.

SUMMARY OF THE INVENTION

The objects described above, as well as other objects and advantages, are achieved by an apparatus and method for connecting composite building panels. A metal tensile connector is used to connect a pair of EPS panels each having a groove extending along one of its edges. The tensile connector includes metal tongue means and metal groove means. The tongue means are mounted within the groove of one of the panels, and the groove means are mounted within the groove of the other panel. Means, in the form of an adhesive, is provided for mounting the tongue means and groove means within the grooved edges of the respective panels. Means are also provided for locking the tongue means within the groove means to frame a hollow connection between the grooved edges of the EPS panels. This hollow connection is filled with a novel concrete to complete the connection between the panels such that tensile forces applied to one of the panels are distributed across the tensile connector to the other panel. This principle is applicable to a plurality of EPS panels for interconnecting the panels to form the foundation, floors, walls, ceiling, and roof of a building.

In a preferred embodiment, the tongue means and groove means of the tensile connector include similar, generally U-shaped metal studs each having a closed end and an open end. The closed ends of the studs are mounted respectively within the grooves in the edges of the panels of EPS, while the open ends of the studs are bent or "rolled" inwardly so that the studs exhibit a generally C-shaped appearance. Means, in the form of a spring clip, is also provided for interlocking the open ends of the studs when the adjacent edges of the EPS panels are brought together to frame the hollow connection between the panels, before filling the tensile connector with concrete.

In an alternative embodiment, the metal studs of the tongue means and groove means are not similar. The closed end of the tongue means stud is attached within the groove in the edge of one of the panels of EPS, while the open end extends outwardly beyond the groove. The closed end of the groove means stud is attached within the groove in the edge of the other adjacent panel of EPS, and the open end of the groove means stud extends outwardly but within the boundaries of the groove. The open end of the tongue means stud is bent outwardly and the open end of the groove means stud is bent inwardly such that the two open ends hook together to lock the tongue means to the groove means, thereby framing a hollow connection between the EPS panels when the grooved edges of the panels are brought together.

Filling the tensile connector with concrete stabilizes and strengthens the connection between the panels of EPS. The concrete provides compressive load bearing capabilities to supplement the tensile load bearing capabilities of the metal tensile connectors in the panel assemblies.

The grooved edges of connected panels are 180° apart and face one another in straight wall, ceiling, and roof applications. However, the edges of the panels can also be oriented 90° apart, or at other suitable angles as desired. For example, 90° T-shaped and cross-shaped tensile connectors are used to connect assemblies of three or four panels, respectively.

Such connections, or assemblies of EPS panels are clearly useful for forming the walls of a building. Another aspect of the present invention contemplates the formation of a building roof assembly supported by such walls. The roof assembly includes a truss assembly supported atop the walls of the building, and an EPS roof panel assembly supported atop the truss assembly. An EPS roof tile assembly is then mounted atop the EPS roof panel assembly to complete the building roof assembly.

In a preferred embodiment, the truss assembly includes a plurality of horizontal trusses, each of which includes an elongated metal channel having several cuts at spaced intervals along the sides thereof, and bends therein to form a saw-toothed shape with uniform crests and troughs. Alternatively, the saw-toothed shape may be formed by assembling a plurality of shorter metal channels in end-to-end fashion. A top track is attached to the crests, and a bottom track is attached to the troughs of the metal channel (s). A pair of EPS sheets is also attached on each side of the bent metal channel, or channels, and extends from the top track to the bottom track. The portion of the truss assembly bounded by the EPS is filled with a concrete mixture for added strength and stability.

In one embodiment, the truss assembly further includes a plurality of gable trusses transverse the horizontal trusses. Like the horizontal trusses, the gable trusses include an elongated metal channel having a plurality of bends therein, or a plurality of shorter channels, to form a saw-toothed shape with non-uniform crests and uniform troughs. The crests and troughs are formed such that their outline approximates the shape of a gable. A top track is attached to the crests and a bottom track is attached to the troughs of the metal channel(s). The gable trusses are completed with a pair of EPS sheets formed in the shape of the gable and attached on each side of the metal channels. Each of the EPS sheets extend from the top track to beneath the bottom track to form a sheath about the metal channel(s).

BRIEF DESCRIPTION OF THE DRAWINGS

In the drawings, wherein like reference characters are used throughout to describe like parts.

DETAILED DESCRIPTION OF PREFERRED EMBODIMENT

Figure 1B:
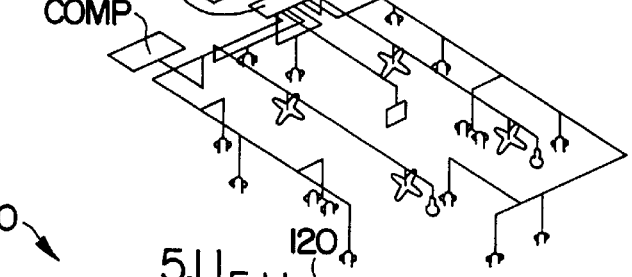
FIG. 1B is a wiring schematic in accordance with the present invention.
Figure 1A:
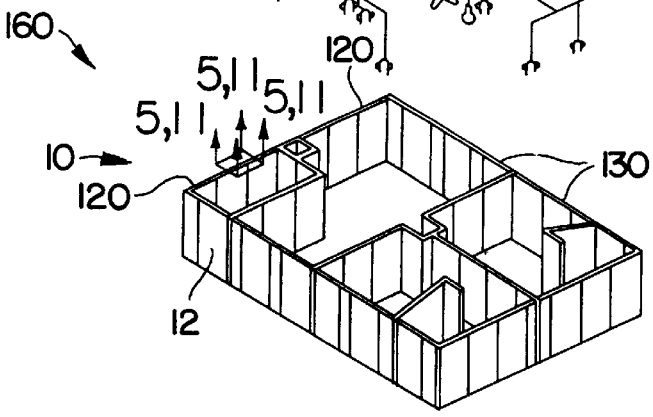
FIG. 1A is a perspective view of a vertical wall assembly for a building in accordance with the present invention.

FIG. 1A illustrates vertical building wall assembly 10 formed entirely of EPS panels 12 that are fitted together as described in greater detail below. The panels are preferably cut at a plant off-site and then transported to the job site so that they can be assembled into a structure such as building 160. Panels 12 can be trimmed or recut at the job site by using portable saws or hot wire equipment. Openings for doorways and windows may be preformed so when foam panels 12 are assembled, the openings are appropriately located. Alternatively, the doorways and window openings may be cut once building 160 has been otherwise erected, as contemplated by FIG. 1A.

The foam material can be formed with a relatively high compressive strength, with the cost and strength being directly related to the weight of the material. EPS weighing one pound per cubic foot can bear weight at the rate of about 30 pounds per square inch. EPS weighing one and one-half pounds per cubic foot bears weight at about 45 pounds per square inch, while EPS weighing two pounds per cubic foot bears weight at about 60 pounds per square inch.

The process for cutting the expanded foam can be made accurate enough that adjacent panels will fit tightly against each other with a barely perceptible seamline, which will be covered when the concrete is sprayed onto the outer surface of the building. The joints can, however, be taped or floated to make sure that none of the seamlines show through the concrete coating.

The cementitious coating, preferably a novel concrete mixture as described below, is typically sprayed onto the EPS base panel assembly in the field. The concrete coating is applied over the entire structure.

Concrete is a hard strong building material made by mixing a cementing material (as Portland cement) and a mineral aggregate (sand and gravel) with sufficient water to cause the cement to set and bind the entire mass. Concrete gets its strength from the interlocking matrix formed by the different size of the aggregate. Specifically, the larger size aggregate create interstices that are filled with smaller sized aggregate that form interstices that are filled with even smaller sized aggregate, and so forth until the matrix is formed of interlocked aggregate from the largest size down to the smallest size, all of which are bound together by the cement.

It is an object and feature of this invention to provide a miniaturized concrete that is particularly suitable for spraying. The novel sprayable concrete mixture comprises Portland cement, "sharp" sand, fibers, water, and calcium-based and quartz aggregates ranging in size from powder to 0.1" (2.5 mm). Preferably, the quartz aggregates are on the greater end of the range, and approach 0.1" in size. The calcium-based aggregates may be pure calcium, XO-size (very fine) marble, O-size (fine) marble, or other suitable calcium-based materials. This type of concrete is "miniaturized" as the aggregates therein are very fine and do not exceed a size of 0.1" (2.5 mm). This enhances the sprayability of the mixture. The sizes of the individual aggregate particles in the concrete mixture are varied, within this range, to ensure the formation of the interlocking matrix between the particles within the mixture, as described above. Also, the smaller aggregate size results in a greater overall aggregate surface area for bonding with the cement/water paste, further improving the strength of the concrete mixture.

This concrete may further include polystyrene powder, and/or zinc sulfide which has been found to improve the insulating properties of the mixture, in addition to any one or all of the ingredients listed above.

One concrete mixture that has been found useful contains Portland cement, sharp sand, graded silicate aggregates, quartz aggregates, fine marble dust ($CaCO_3$), monofilament polymer fibers, lime and polymer resin polymers. A mixture which has been found particularly suitable is set forth below according to dry and wet component quantities:

| Dry Components | Weight (lbs) | Percent |
|---|---|---|
| No. 2-sized quartz and flint | 140 | 6.4 |
| No. 4-sized silicates | 200 | 9.1 |
| O-sized or XO-sized marble dust | 600 | 27.2 |
| Portland cement | 470 | 21.4 |
| sharp sand | 680 | 30.9 |
| fine hydrated lime | 100 | 4.6 |
| Polypropylene monofilament fibers | 10 | 0.4 |
| TOTAL OF DRY COMPONENTS | 2200 | 100.0 |
| **Wet Components** | **Volume (gal)** | **Percent** |
| vinyl acrylic polymer fortifier | 13.1 | 43.7 |
| water | 16.9 | 56.3 |
| TOTAL OF WET COMPONENTS | 30.0 | 100.0 |

The vinyl acrylic polymer fortifier is a powdery liquid polymer, either chemical or electrical (anionic), that is dissolved in water to form a polymer fortifier matrix, similar to latex wall paint. Such polymer fortifiers can be purchased from Rohm & Haas Texas, Inc. at its Deer Park, Texas office, under its trademark "Rhoplex MC-76."

The fibers are formed of virgin (non-processed) homopolymer (single-polymer) polypropylene with a length ranging from ⅛" to ½", with a specific gravity of approximately 0.91. The density of the fibers is much greater than that suggested in the prior art. In the above-described embodiment, 10 lbs of fibers is used in the mixture as compared to 1.5 lbs of fibers in a comparable volume of a prior art concrete. This embodiment, which is set forth in quantities producing roughly one cubic meter of concrete, therefore contains approximately 100 million fibers per cubic meter. This translates to a fiber density of 1639 fibers per cubic inch of concrete. The fibers are preferably of ¼" and ½" lengths in about a 50/50 ratio, i.e., 50 million of each length per cubic meter of the concrete mixture. The shorter fibers provide a better dispersal and more even distribution of the resulting fiber netting (described more below) in the mixture. Such fibers can be purchased from the FIBER-MESH® division of Synthetic Industries, headquartered in Chattanooga, Tennessee.

The concrete is mixed in a truck and pumped through a hydraulic pump such that a pressure of 75 lbs. per square inch is maintained in a 1 inch diameter hose. Compressed air is pumped through the hose at 75–165 lbs. per square inch, so that the concrete mixture is sprayed as an aerated slurry through a nozzle onto the outer surface of EPS panels 12. It has been found that spraying provides a combination of aerating, dehydrating and cooling of the concrete during the time it leaves the nozzle to the time it is deposited onto the outer surface of the panels 12. Spraying also enhances the venting of hydrogen gas from the concrete mixture that is formed during the combination of water and cement (discussed further below). The sprayed concrete adheres to the outer surface of the panels 12 and can be applied in thin layers by passing the nozzle back and forth across the assembly of panels 12.

The size of the sand can be varied in order to change the texture of the coating. The marble dust is believed to cause the mix to coagulate and to create a fine aggregate that resists shrinkage of the polymer concrete as it cures, which enhances the non-shrinking characteristic caused by spraying. Marble aggregate is used in greater quantities than ever suggested by the prior art, preferably in the form of marble dust. The cement, CaCO, is combined with water in the mixture to create a cementitious matrix similar to limestone. The calcium in the marble aggregate, which is crystalline $CaCO_3$, accelerates the "set-up" of the cement once the water has been added, enabling the cement matrix to assume a stronger shape before being deformed by the polymer fortifier matrix. The marble also absorbs the heat of reaction that is created by the combining of the cement, CaCO, with the oxygen from two water molecules. This heat absorption by the marble significantly reduces the expansion of the cement matrix by the hydrogen gasses and other trace gasses released by the combination reaction.

Conventional concrete is formed in accordance with the following chemical equation:

$$CaCO+2H_2O \rightarrow CaCO_3+2H_2+\text{heat}.$$

The concrete of the present invention, by contrast, is formed in one embodiment according to the following equation:

$$CaCO_3+CaCO+2H_2O \rightarrow 2CaCO_3+2H_2+\text{heat}.$$

The same amount of heat is created in the exothermic reactions represented by both equations, but there are two molecules of $CaCO_3$ in the mixture of the present invention for every molecule of $CaCO_3$ in conventional concrete. Other embodiments contemplate the use of even more marble aggregate in the mixture. Preliminary tests indicate that the optimum range is 120–130% by weight of marble aggregate per weight of cement in the mixture. The resulting increase of $CaCO_3$ molecules significantly enhances the ability of the cementitious matrix to dissipate the heat of reaction and therefore control the temperature rise and expansion of the hydrogen gas released by the reaction.

Figure 21A:
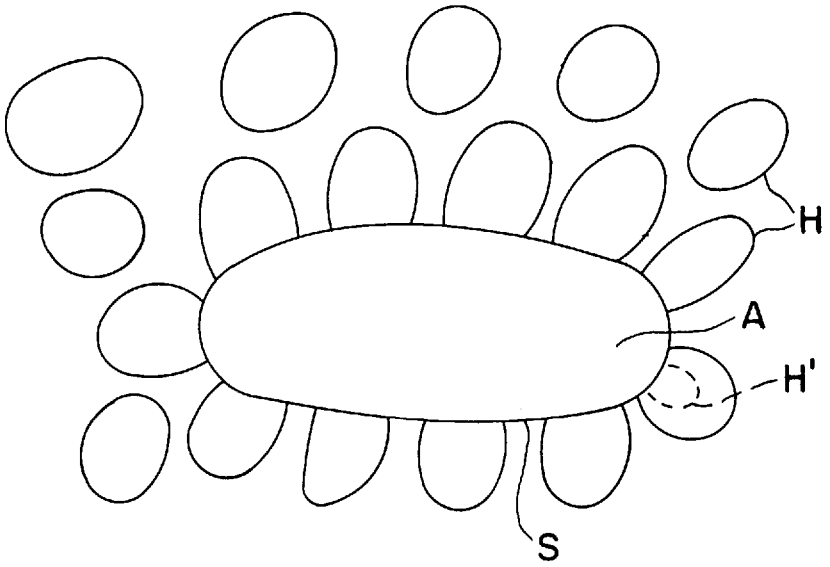
FIG. 21A is a magnified representation of hydrogen gas bubbles formed about an aggregate in conventional concrete.

FIG. 21A is an illustration of hydrogen gas bubbles H formed about aggregate A by the combination of water and cement in the prior art. The heat of reaction results in the formation of large bubbles that inhibits the amount of surface area S of aggregate A that is available for bonding with the cementitious matrix surrounding the aggregate.

Figure 21B:
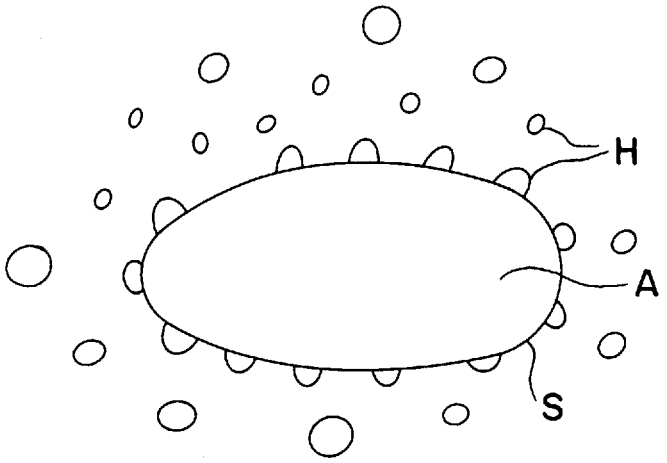
FIG. 21B is a magnified representation of hydrogen gas bubbles formed about an aggregate in a cementitious matrix according to the concrete mixture of the present invention.

By contrast, FIG. 21B illustrates hydrogen gas bubbles H formed during the reaction of cement with water in the marble aggregate-rich mixture of the present invention. The hydrogen gas bubbles in the cementitious matrix do not expand significantly and much more of the aggregate's surface area S, up to four times as much as in conventional concrete, is exposed to the cementitious matrix for bonding therewith. The resulting concrete is more dense and more uniform throughout than conventional concrete products. Less cement is therefore required per volume to achieve the desired strength, because the increased density provides for better "gripping" of the short polypropylene fibers. Furthermore, the increased density results in a finished product that is thermally stabilized, i.e., it is slower to react to heat gain or heat loss.

Thus, the thermal expansion of the hydrogen gas bubbles in the present invention is limited because, due to the cooling effect of the increased $CaCO_3$ in the mixture, the hydrogen bubbles do not experience high temperature swings. This is contrasted with conventional concrete, wherein the heat of reaction is concentrated in 50% fewer molecules of $CaCO_3$, or less, and results in significant expansion of the gas bubbles and subsequent contraction as the heat is gradually transferred to the surrounding environment. This is shown by hydrogen gas bubbles H and H', respectively, in FIG. 21A. As the hydrogen bubbles cool and contract in size, cracks may be formed in the cementitious matrix that weakens the resulting structure. Such crack formation is much less likely to occur in the present invention.

Quartz is preferred as the largest aggregate compound for use in bonding with the cementitious matrix because the resulting increase in exposed aggregate surface area, as seen in FIG. 21B, produces a greater bond between the aggregate and the cementitious matrix. The matrix then applies greater shear forces to the aggregate when the heat of reaction is dispersed among the $CaCO_3$ in the matrix to produce thermal "movement" of the matrix. The hardness of quartz is well suited for withstanding the increased shear.

The fibers are believed to hold the mixture together during the spray process as well as to provide flexibility to the mixture after it has been applied in order to resist cracking due to shifting in the building. The fibers produce a third, cloth-like netted matrix within the cementitious matrix that is shatter resistant because shock waves transmitted to the concrete are absorbed by the polypropylene monofilament (fiber) netting. The finished concrete product is supple and flexible, and can receive sheet metal screws or nails because of the density of the cement matrix, the inherent qualities of the fortifying polymer matrix, and the netting of the polypropylene monofilaments.

The unique combination of the mixture and the application through a spraying process provides an extremely strong shell for a typical building 160, which shrinks slightly without cracking upon application in order to give a pre-stressed skin or monocoque coating to the building. Shrinking is reduced during the curing process because the expansion of hydrogen and other gasses in the mixture is significantly reduced.

Within twelve to twenty-four hours after the initial spray, the coating has hardened but is still soft enough to carve. This allows the use of tools to carve various designs in the outer surface of the coating or the use of grinding equipment in order to smooth the coatings. For example, an initial base coat could be applied of a gray color, with an outer coat of the concrete which has a reddish hue. By carving grooves to expose the gray coat underneath would provide a surface finish that had the appearance of brick.

Various layers can be applied to the EPS sections 12 at any point in time since the vinyl acrylic will polymerize with the acrylic in the preceding layer so that one continuous layer is provided even though it is applied at different times.

A pigment can be added to the concrete as it is mixed in the truck so that the color is integral. After the concrete has cured, an outer sealer coat formed of an acrylic paint can be applied which is the same color as the pigment in the concrete, if the concrete is colored. Thus, if the outer coat is fractured in some way, it would not be readily apparent since the concrete base has the same color.

In houses or other buildings, the coating is applied to the EPS panels and pieces that form or cover the entire building resulting in a concrete shell that is firmly bonded to the EPS base. The resulting structure exhibits a very low overall heat transfer coefficient, and is thus highly energy efficient. Vents may also be provided where considered desirable or necessary.

The cementitious layer is also known to provide a protective coating that increases the durability of the foam layer. This durability makes composite-based panels very desirable for use in constructing the walls, ceilings, and roofs of buildings. Walls are formed, for example, by vertically interconnecting panels of EPS and then coating the panel assembly with the cementitious material by troweling or spraying.

It has been found that the EPS panels are easy to handle because they are light in weight and can be lifted and carried by one or two workmen depending on the size of the panel. For example, the wall panels are preferably three and one-half inches thick and formed in rectangular EPS sheets that are 2–4 feet by 6–8 feet. Roof panels are larger in area, and are preferably three and one-half inches thick. Interior and exterior walls can be used as beams for supporting the roof panels as shown in FIG. 1A, and other components of a roof assembly as shown in FIGS. 2A–2D, so that additional beams are not necessary. Cross beams or supports are used when creating different roof slopes, and when additional structural support is needed, as is further demonstrated in FIG. 2A.

Figure 3:
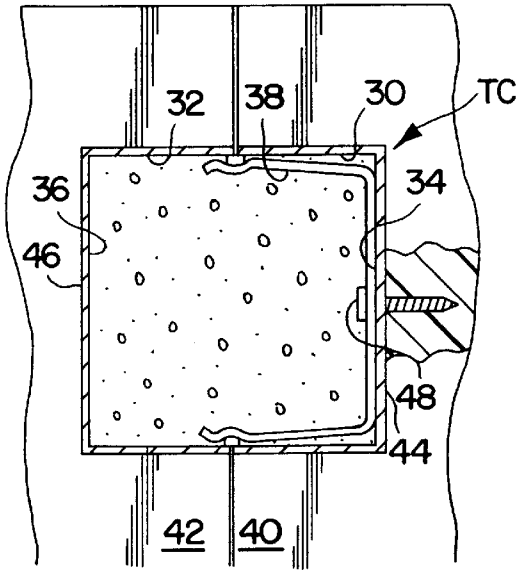
FIG. 3 is a partial elevational view, partially in section, of a tensile connector for connecting the adjacent edges of EPS building panels.

In order to distribute tensile forces and maintain the alignment of adjacent EPS panels 12, a tongue and groove assembly is used on adjacent edges of the panels. As shown in FIG. 3, the adjacent edges of typical EPS roof panels 40, 42 are provided with grooves 44, 46 in their respective edges. Panels 40, 42 are assembled to one another with tensile connector TC which includes two metal studs 30 and 32. Closed ends 34, 36 of studs 30, 32 are attached with a suitable adhesive respectively within grooves 44, 46 in the edges of panels 40, 42. The open ends of the studs are bent, or "rolled" inwardly resulting in a C-shape.

The adhesive may either a hot epoxy or a chemical adhesive, suitable for bonding the surfaces of the metal studs to the EPS panels. One epoxy that has been found to be particularly useful is EnerBond™ Spray Foam Adhesive manufactured by Abisko Manufacturing Inc. of Ontario, Canada. The epoxy may include an accelerator "kicker" that controls the time at which the epoxy becomes "active" and bonds the studs to the EPS panels. In one embodiment, the epoxy is heated to approximately 250° F, which enhances the bonding capability of the epoxy and also causes the epoxy to burn through and penetrate the pores of the EPS, in somewhat analogous fashion to fingers within a bowling ball. This process significantly increases the surface area of the EPS panels that is bonded by the epoxy. As a result, the strength of the bond between the metal studs and the EPS sheets far exceeds that of conventional "scale" bonding wherein only the portion of the EPS material that is flush with the bonding surface is actually bonded. This is also true in the case of bonding one EPS panel or sheet to another EPS panel or sheet.

Spring clip 38 is mounted to stud 30 and panel 40 with screw 48. The spring clip interlocks the open ends of studs 30, 32 when the adjacent edges of panels 40, 42 are brought together to frame a hollow connection between the panels. In this fashion, spring clip 38 and stud 30 form tongue means which engages the groove means of stud 32. The tensile connection between the panels is completed by filling the hollow framed connection with the concrete mixture described above.

Figure 4A:
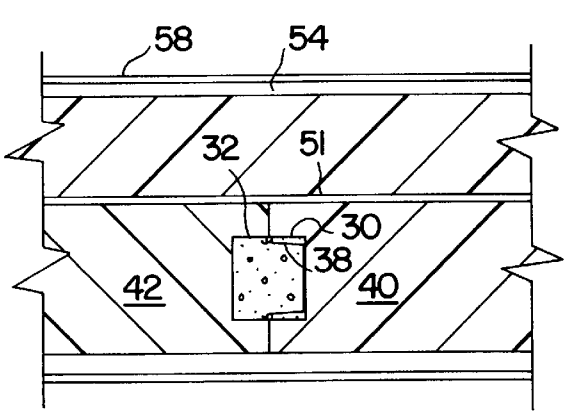
FIGS. 4A–4C are partial elevational views of a roof assembly in accordance with the present invention, taken along section 4—4 that extends through FIGS. 2B–2D.
Figure 4B:
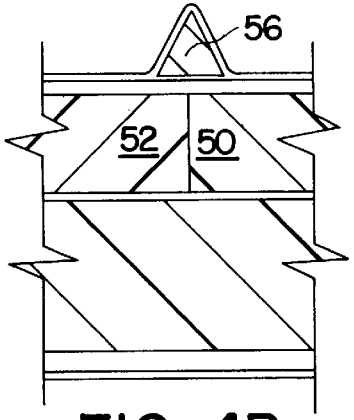
Figure 4C:
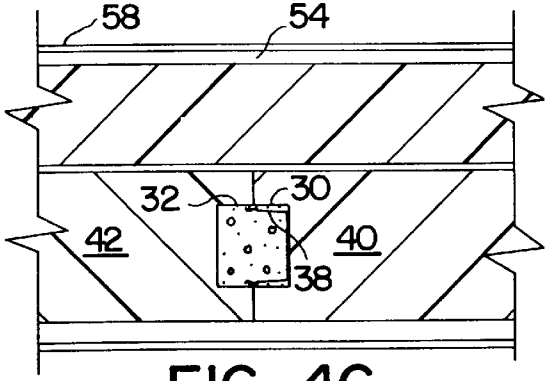

Thus, the EPS panels are connected such that tensile forces applied to one of the panels are distributed across the tensile connector to the other panel once the connector has been filled with concrete. One application of this tongue and groove tensile connector is shown in the typical roof panel assembly of FIGS. 4A, 4B, and 4C, wherein three and one-half inch EPS roof panels 40 and 42 are respectively connected with a pair of connectors each including studs 30, 32 and clip 38. Once the roof panels are assembled, the tensile connectors are filled with concrete for improved structural strength. Three inch EPS roof tiles 50, 52 are mounted atop the roof panels with 5mm layer 51 of concrete in staggered fashion such that the seams of the roof panels do not align with the seams of the roof tiles. The roof tiles are topped with equilateral EPS cap strips 56, and then both the tiles and cap strips are coated with 15mm layer 54 of concrete. The staggered placement of the cap strips, roof tiles, and roof panels relative to one another, and the intermittent layers of concrete form multiple moisture barriers to keep the inside of the building dry. The entire roof assembly is then coated with a sealing layer 58, such as a vinyl acrylic.

Figure 5:
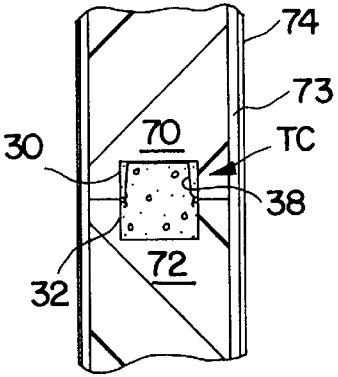
FIG. 5 is a partial plan view of a wall assembly in accordance with the preset invention, taken along section 5—5 in FIG. 1, FIGS. 6, 7, and 8 are partial plan views of L-shaped, T-shaped, and cross-shaped tensile connections, for connecting two, three, and four EPS wall panels, respectively.

Another typical application of tensile connector TC is shown in the wall panel assembly of FIG. 5. Three and one-half inch EPS wall panels 70 and 72 are vertically assembled using metal studs 30, 32, and metal spring clip 38. The outer surfaces of both panels are coated with a 10mm layer 73 of concrete and a sealing layer 74. Tensile connector TC is also filled with concrete. The combination of the metal studs and the concrete filling ensure that the wall assembly is capable of bearing both tensile and compressive loads that may be applied to it.

The novel use of the metal studs that make up the tensile connector in combination with the EPS foam panels represents a sort of symbiotic relationship. The metal studs provide a structural skeleton which eliminates or straightens out the irregularities that maybe present in the foam panels. The panels provide insulation, particularly in the roof and outer wall assemblies, to minimize thermal expansion and contraction of the studs in the presence of ambient temperature changes. In addition to temperature stabilization, the EPS also absorbs energy to insulate the metal studs from destructive shock impacts or other movement.

Figure 11:
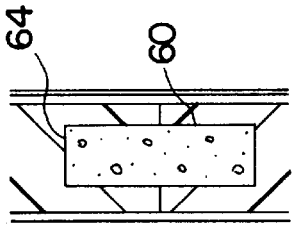
FIG. 11 is a partial plan view of a wall assembly in accordance with the tensile connector of FIG. 9, taken along section 11—11 in FIG. 1.
Figure 9A:
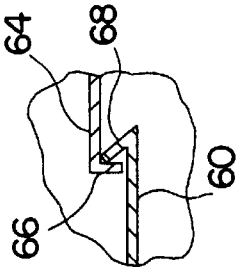
FIG. 9A is an enlarged sectional view of the locking surfaces of the tensile connector of FIG. 9.
Figure 9:
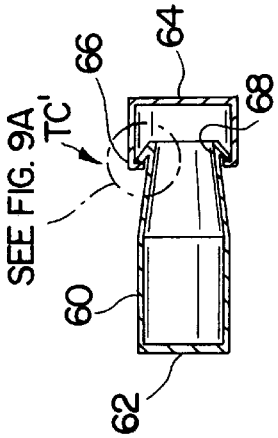
FIG. 9 is a sectional view of an alternate embodiment of the tensile connector of the present invention.
Figure 10:
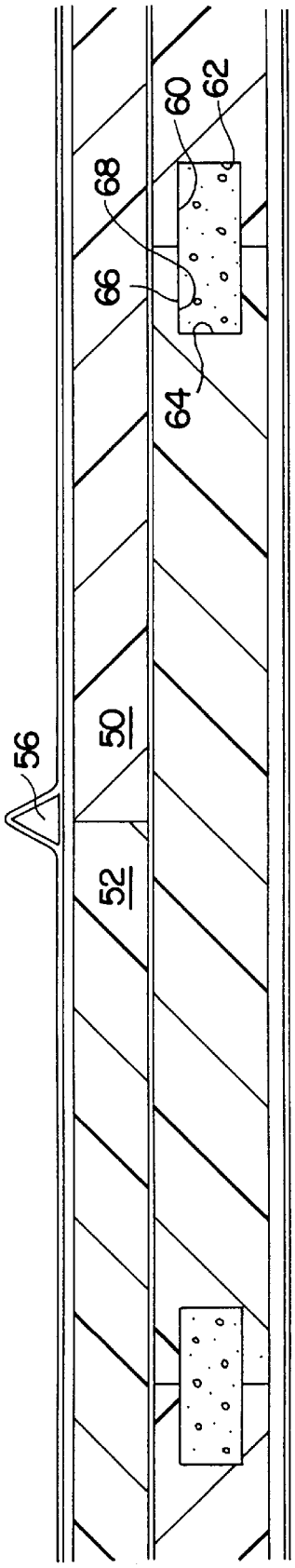
FIG. 10 is an elevational view of a roof assembly in accordance with the tensile connector of FIG. 9, taken along section 10—10 that extends through FIGS. 2B–2D.

In an alternative embodiment shown in FIGS. 9 and 9A, tensile connector TC' includes metal tongue means 60 having a closed end and an open end. Closed end 62 of the tongue means is attached within the groove in the edge of one of the panels of EPS, while the open end extends outwardly beyond the grooved edge of the panel. The tensile connector further includes metal groove means 64 also having a closed end and an open end. The closed end of groove means 64 is attached within the groove in the edge of an adjacent panel of EPS, and the open end of the groove means extends outwardly, but within the groove in the panel. Open end 66 of groove means 64 is bent inwardly, and open end 68 of tongue means 60 is bent outwardly more than 90°. This structure ensures that outwardly bent open end 68 of tongue means 60 will first be deformed inwardly and then snap back outwardly as it is slid and hooked within inwardly bent open end 66 of groove means 64 by the edge-to-edge assembly of the panels of EPS. Such assembly is shown for a typical roof panel assembly in FIG. 10 and a typical wall panel assembly in FIG. 11.

Filling the tensile connectors with concrete stabilizes and strengthens the connection between the panels of EPS. As indicated above, the concrete provides compressive load bearing capabilities to supplement the tensile load bearing capabilities of the metal tensile connectors in the panel assemblies.

The tensile connectors thus reinforce the construction panel systems at their weakest areas, the points of connection between the panels. The continuity of the concrete in the tensile connector and the bond of the adhesive between the tensile connector and the grooved edges of adjacent EPS panels provides a strong tensile connection at the joint between the connected panels. Thus, forces are transferred and distributed among the panels through a plurality of such tensile connections. These tensile connections are adapted for withstanding great tensile forces that would tend to pull the connected panels apart, such as the pressure differential across the walls of a structure that is experienced during a hurricane, for example. The resulting tensile connection is further believed to provide dimensional stability of the joined panels, and limit warping of the EPS panels, both of which result in greater precision in the finished structure and a virtually "seamless" appearance at the panel interfaces. In other words, the finished form does not exhibit a "panelized" appearance.

The grooved edges of the connected panels are 180° apart in "straight" wall, ceiling, and roof applications. This is illustrated in FIGS. 4, 5, 10, and 11. However, the grooved edges of the EPS panels may also be oriented 90° apart, or at virtually any other angle as is desired. For example, L-shaped, T-shaped, and cross-shaped wall junctions, are shown in FIGS. 6, 7, and 8, respectively.

Figure 6:
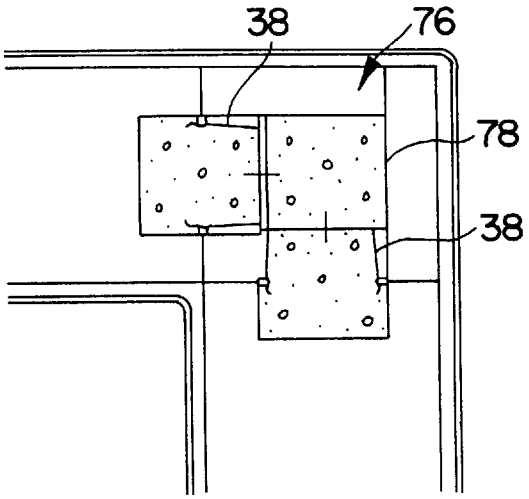

FIG. 6 displays an L-shaped connection of two exterior walls in a building. The connection is made through L-shaped tongue means 76 that includes metal stud 78 and a pair of spring clips 38 attached to the stud with metal screws 90° apart from one another.

Figure 7:
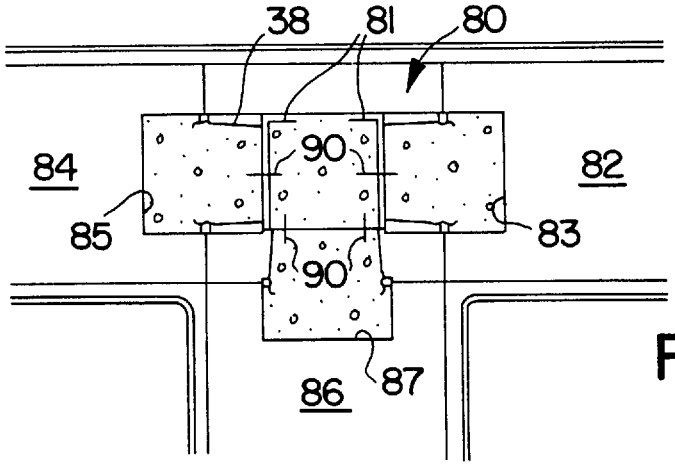

In FIG. 7, T-shaped tensile connector 80 is used to connect three EPS panels 82, 84, and 86 each of which has a groove in its adjacent edge. This connector has a metal tongue means at each of its three ends, represented by spring clips 38. These tongue means engage the metal groove means represented by studs 83, 85, and 87, respectively, which are attached to the panel grooves with a suitable adhesive. The spring clips are assembled in a T-shape using metal screws 90 and a pair of opposing studs 81. Tensile connector 80 is filled with concrete once the three panels are assembled.

Figure 8:
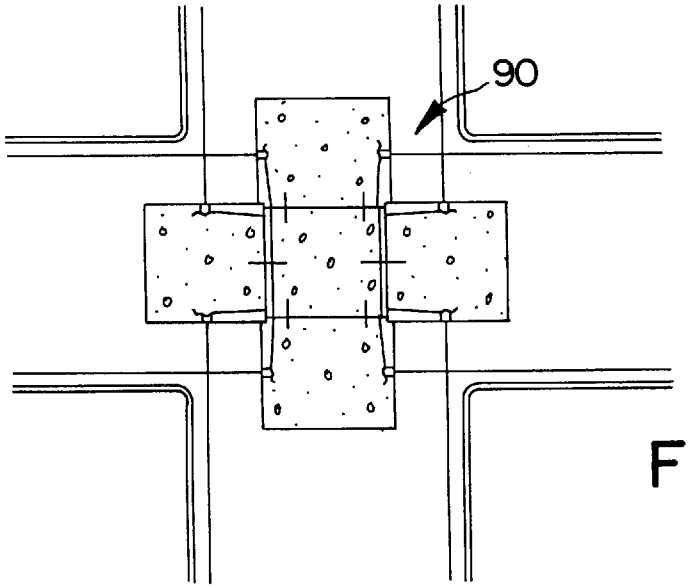

FIG. 8 illustrates the use of cross-shaped tensile connector 90 for connecting the adjacent grooved edges of four panels of EPS. This connector has four metal tongue means, and adhesive is again used for attaching each of the metal groove means of the tensile connector respectively within the grooves in the panels of EPS to permit the connection of the four EPS panels. Tensile connector 90 is also filled with concrete to complete the assembly.

Figure 20C:
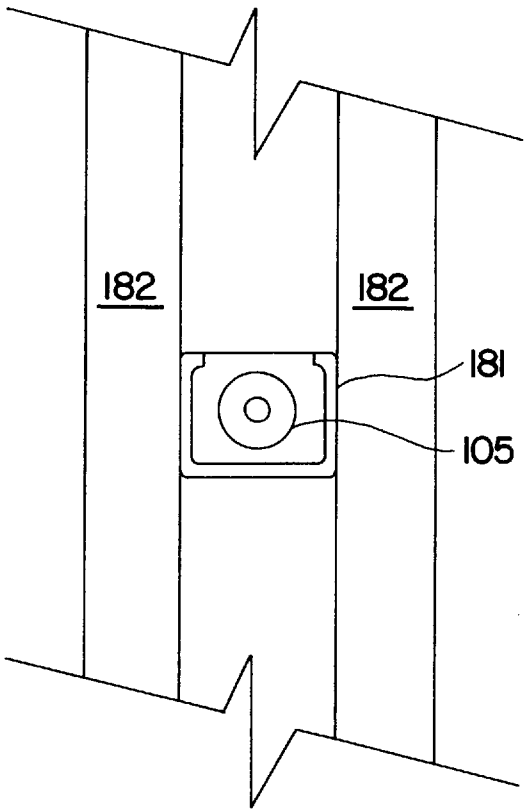
FIG. 20C is a partial plan view of a gable truss including a vertical riser stud for running an electrical conduit.

FIGS. 12–16 illustrate that walls formed of EPS panel assemblies are useful for supporting the roof assembly of a building, preferably by means of truss assembly TR intermediate the walls and roof assembly. Truss assembly TR includes a plurality of horizontal truss components, such as horizontal trusses 93, tie beams 93T, and ridge trusses 93R. Each of the horizontal truss components includes an elongated metal channel 94 of a C-shaped or U-shaped cross-section. The sides of the channel are cut in several places so that the channel can be bent to form a saw-toothed shape with uniform crests 96 and troughs 98. As shown more particularly in FIGS. 14A and 20A, each truss includes top track 100 welded or otherwise fastened to the crests, and bottom track 102 welded or otherwise fastened to the troughs of bent metal channel 94. Metal stud 103 is attached to the bottom of bottom track 102 for carrying electrical conduit 105, which is preferably PVC. A pair of EPS sheets 104 and 106 is also attached on each side of the bent metal channel using adhesive and extends from top track 100 down beneath bottom track 102, and forms a U-shaped sheath with EPS sheet 110.

In an alternate embodiment, short channel pieces are used in place of the cut and bent elongated channel 94 to form the saw-toothed shaped of the truss.

The portion of the truss bounded by the EPS sheets is typically filled with a concrete mixture for added strength and stability, after being hung from the roof assembly with lag screws 108 and/or truss hanger 126, as appropriate. In some instances, however, it is desirable that the trusses be only partially filled with concrete, or not at all, to avoid excess weight in the truss assembly in areas where further reinforcement is not required.

Figure 15:
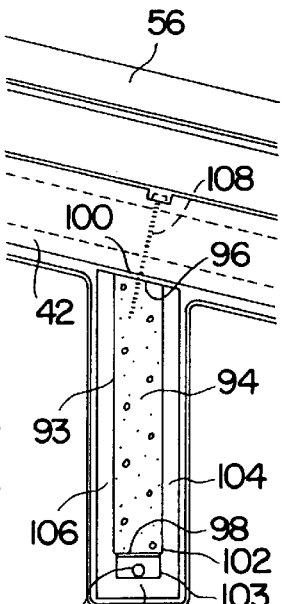
FIG. 15 is a partial elevational view of a horizontal truss, for supporting a roof assembly on the walls of a building.
Figure 14:
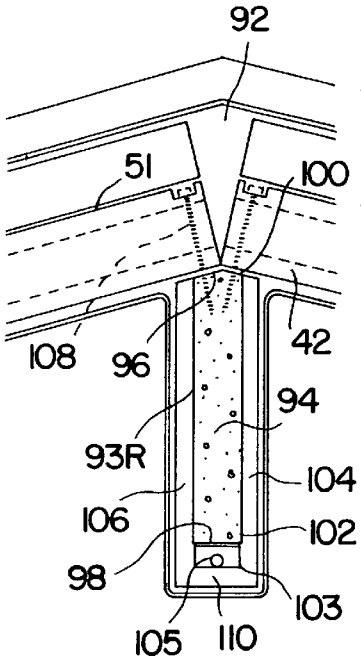
FIG. 14 is a partial elevational view of a ridge truss, for supporting a roof assembly on the walls of a building.
Figure 14A:
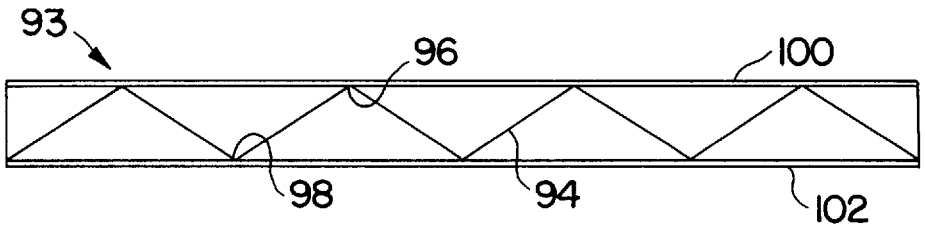
FIG. 14A is a side elevational view of the horizontal tie beam in FIG. 14 shown without the EPS sheath.

FIGS. 14 and 15 illustrate typical ridge and horizontal trusses 93R and 93, respectively, supported by hangers 126 at the exterior walls of the building. The interface of truss 93 with hanger 126 is shown in the side elevational view of FIG. 12.

Figure 2D:
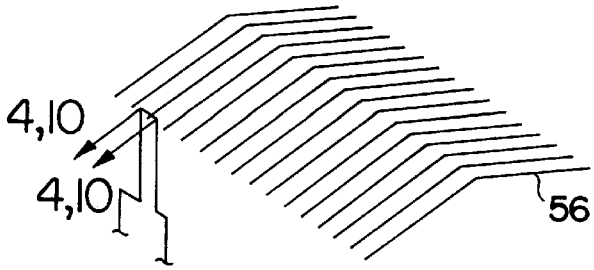
FIGS. 2A–2D depict sequentially perspective views of the stages of constructing a roof assembly for a building in accordance with one embodiment of the present invention.
Figure 2C:
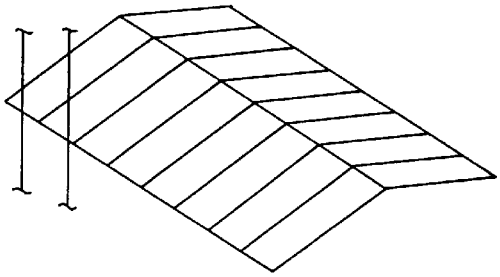
Figure 13:
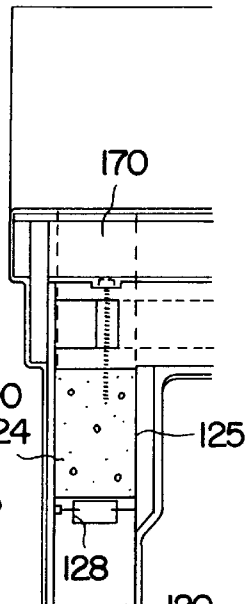
Figure 12:
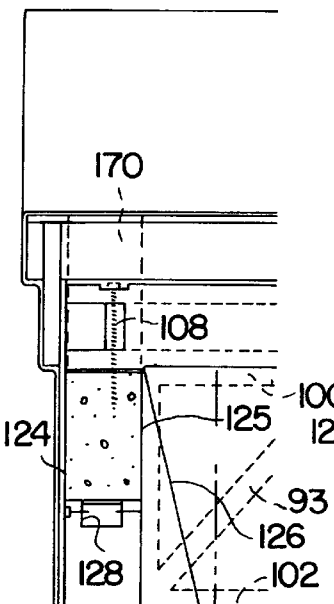
Figure 18:
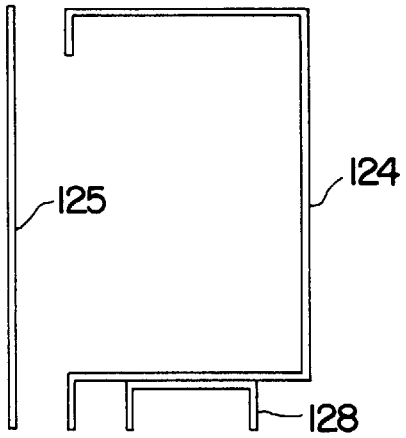
Figure 19:
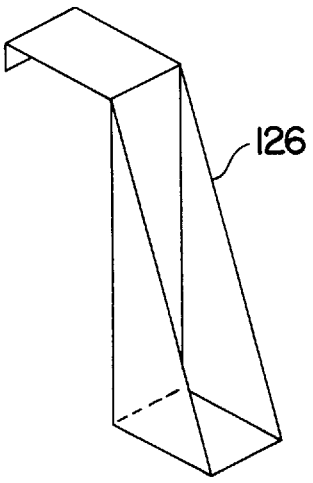
FIG. 19 is a hanger for supporting the trusses of FIG. 14 or 15 with the exterior walls of a building or with a horizontal tensile connector, as shown in FIG. 12.

Truss assembly TR further includes a plurality of gable and mid-span trusses 170 and 170M. FIGS. 1 and 2A display the exterior walls of building 160 providing support for the roof assembly at gables 170 and tie beams 93T. In one embodiment illustrated in FIG. 12, horizontal tensile connector 124 is welded or otherwise fastened to stud 128 for attaching the tensile connector to wall 120. Cover plate 125, also shown in FIG. 18, completes and closes tensile connector 124 so that it may be filled with concrete. Hanger 126, also shown in FIG. 19, is landed upon and mechanically fastened to horizontal tensile connector 124. FIG. 13 also shows gable 170 supported atop wall 120, but differs from FIG. 12 in that the former is taken along a section where there is no horizontal truss 93 or hanger 126.

In an alternate embodiment (not shown), hanger 126 is landed directly atop the walls of building 160, such as over the tensile connector that vertically connects adjacent wall panels of EPS.

Figure 16:
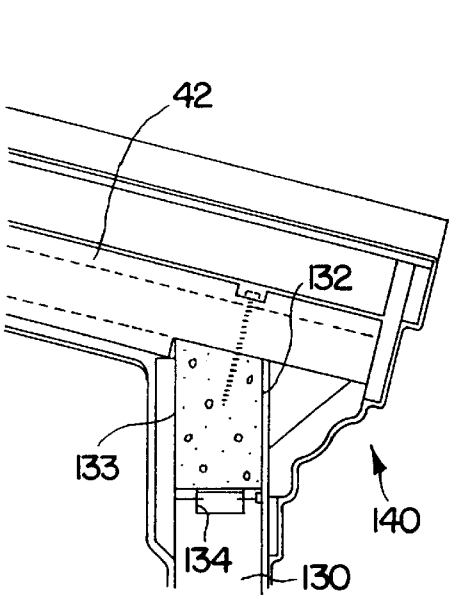
FIGS. 12, 13, and 16 are partial elevational views of horizontal tensile connectors for supporting a roof assembly on the walls of a building.
Figure 17:
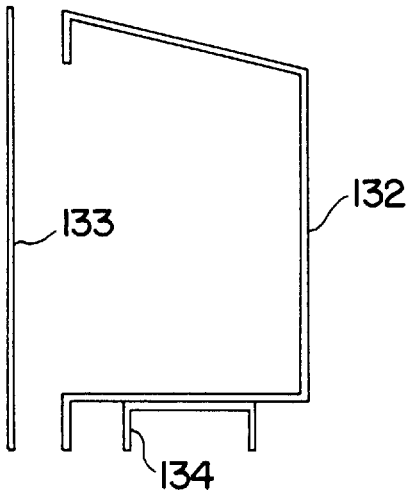
FIGS. 17 and 18 are enlarged views of the horizontal tensile connectors and cover plates of FIGS. 16 and 13/12, respectively.

FIGS. 16 and 17 display horizontal tensile connector 132 which connects wall 130 to the roof assembly near cornice 140. Cover plate 133 completes the tensile connector, and connector 132 is filled with concrete for strength and stability of the resulting assembly.

Figure 20B:
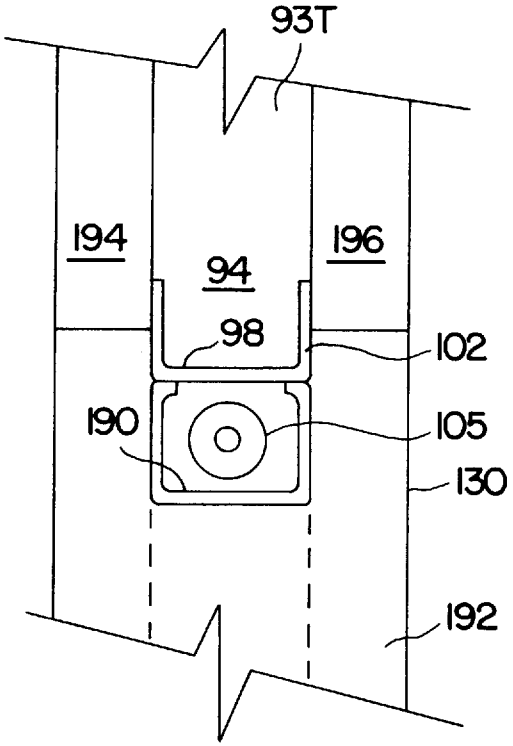
FIG. 20B is a partial elevational view of a preferred embodiment for connecting the trusses and tie beams of FIG. 2A to the walls of FIG. 1A.
Figure 20A:
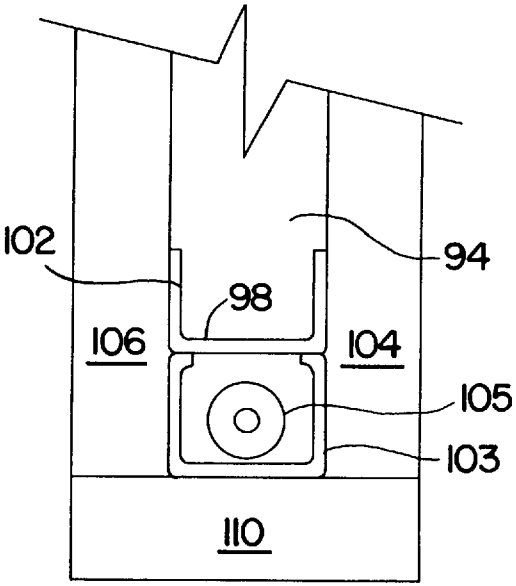
FIG. 20A is a partial elevational view of a horizontal truss in accordance with the present invention.
Figure 20F:
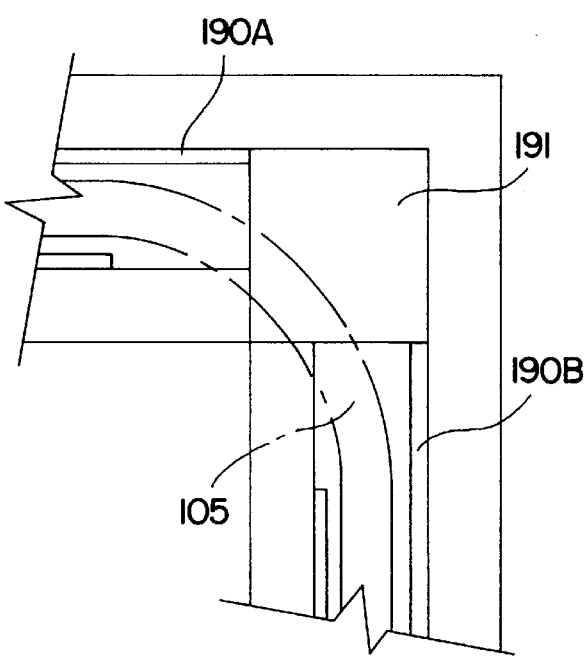
FIG. 20F is a partial plan view of a corner junction between perpendicular wall panel assemblies including a horizontal track for running an electrical conduit.

In the preferred embodiment, tie beam 93T is landed directly atop wall 130, as contemplated by FIGS. 1, 2A, and 20B. The apparatus of FIG. 20B is suitable for connecting portions of truss assembly TR, also known as the roof subframe, such as horizontal tie beams and gable trusses directly to the wall assembly. Metal stud 190 is attached to a groove extending along the upper edge of wall panel 192 using an adhesive. Tie beam 93T having EPS sheets 194 and 196 attached to the sides thereof is lowered onto wall panel 192. Bottom track 102 welded to troughs 98 of bent metal channel 94 of tie beam 93T is also attached to stud 190 using an adhesive and/or mechanical fasteners such as metal screws (not shown). PVC conduit 105 is run through stud 190 as necessary for electrical and telecommunication wiring. Stud 190 and tie beam 93T are then filled with concrete to form a horizontal tensile connector suitable for distributing and transferring loads from the roof subframe to the wall assembly and vice versa. Tie beam 93T can, in some cases, be only partially filled or left unfilled as appropriate for load bearing purposes. This alternative apparatus may be used in place of the horizontal tensile connectors described above, and can result in a lower concrete fill requirement as well as reduce the weight supported by the wall assembly.

An EPS roof panel assembly including panel 42, such as that described above and shown in FIGS. 4A, 4B, and 4C, is supported atop the truss assembly. The grooved edges of the roof panels wherein the metal tensile connector studs are received and attached are represented by dashed lines in the roof panels in FIGS. 12–16. An EPS roof tile assembly is mounted atop the EPS roof panel assembly with 5mm layer 51 of concrete to complete the building roof assembly. Concrete is poured into ridge opening 92 for filling the tensile connectors assembling the roof panels on either side of the ridge opening. EPS cap strips are mounted atop the tile assembly at and midway between the seams of the tiles with a heavy layer of concrete and a top seal cote to provide additional moisture protection.

As mentioned above, truss assembly TR further includes a plurality of gable and mid-span trusses transverse horizontal tie beams 93T and trusses 93. FIGS. 1 and 2A–2D illustrate the construction sequence of building 160 in accordance with this embodiment.

The mid-span trusses are identical to the gable trusses, with the exception that in some cases the mid-span trusses do not extend completely across the width of the building, as seen in FIG. 2A. Thus, gable trusses 170 include elongated metal channel 172 having a plurality of cuts and bends therein to form a saw-toothed shape with non-uniform crests 174 and uniform troughs 176. The crests and troughs are formed such that their outline approximates the triangular shape of the gable. As in horizontal trusses beams described above, top track 178 is attached to the crests and bottom track 180 is attached to the troughs of bent metal channel 172. Gable trusses 170 are completed with a pair of EPS sheets 182 formed in the shape of the gable and attached on each side of the bent metal sheet. Each of the EPS sheets extend from the top track to beneath the bottom track to form a sheath about metal sheet 172.

Gable trusses 170 further include riser studs 181, as shown in FIGS. 2A and 20C, for running electrical conduit 105 between the walls and roof subframe of the building. In this manner, electrical wiring is run through PVC conduit that extends upwardly through the gable trusses and bends to extend along horizontal trusses 93, ridge trusses 93R, and tie beams 93T, for providing electricity to light fixtures in ceilings, and switches and plugs in the walls of building 160, as contemplated by the wiring schematic of FIG. 1B.

Figure 20E:
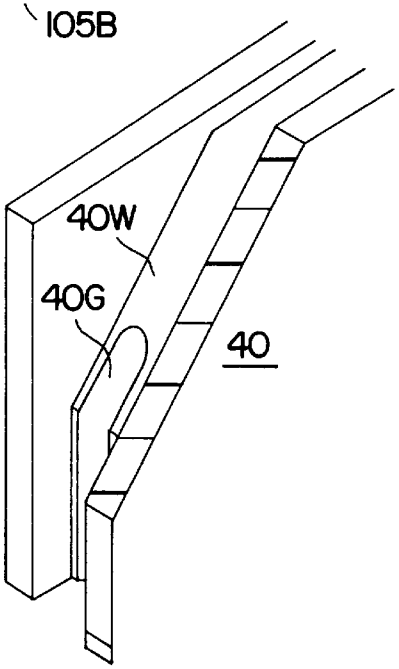
FIG. 20E is a partial sectional view of a wall panel having an inner wedge-shaped portion removed for running a 90° bend in an electrical conduit.
Figure 20D:
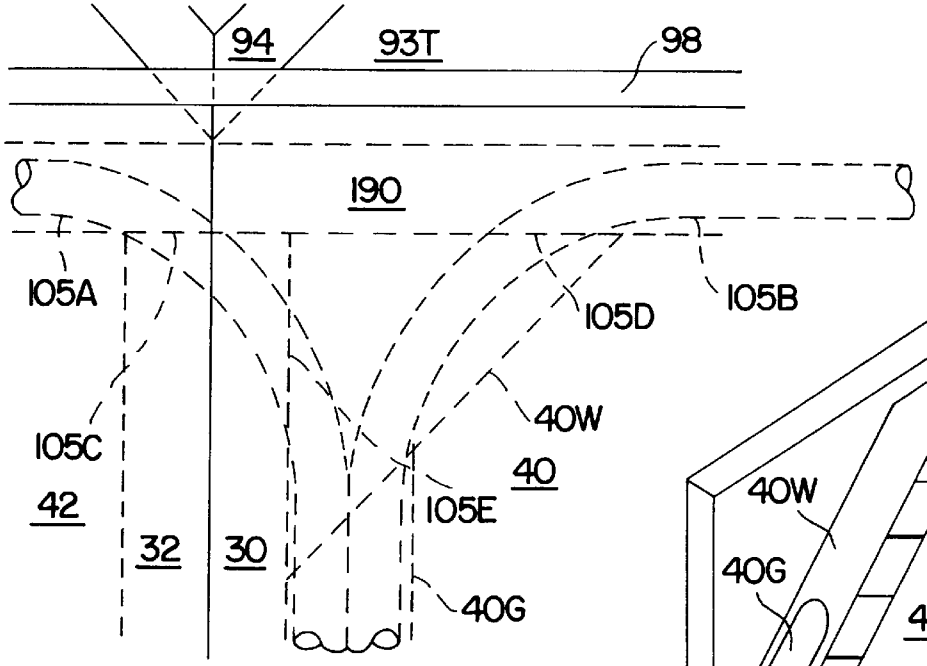
FIG. 20D is a partial elevational view of a wall panel assembly including a groove for running electrical conduit adjacent the tensile connector.

FIGS. 20D and 20E illustrate the placement of PVC conduit 105A and 105B in groove 40G for running electrical wiring in wall panel 40 adjacent the tensile connector formed by studs 30, 32. Conduit 105A is bent 90° and passes through opening 105E in stud 30 and opening 105C in stud 190 of tie beam 93T. Conduit 105B passes through opening 105D in stud 190 of tie beam 93T. In this fashion, electrical wiring is run through wall panels, ceiling panels, and trusses to create circuits between wall plugs and switches, light fixtures, junction boxes, electrical panels, and the like.

FIG. 2OF is a partial plan view illustrating PVC conduit 105 formed in a 90° bend to run electrical wiring between studs 190A and 190B. The edges of the studs inside the radius of the bend in the conduit are cut back approximately 2 inches to avoid interference with the conduit. Cavity 191 is filled with concrete following installation of conduit 105.

The joining of a wall panel to a roof panel, as described above, is commonly know as a "moment connection." Such moment connections are strengthened by the continuity of the concrete mixture within the tensile connector that connects the panels together, which provides a solid anchor for the connection of the wall panel assemblies to the roof panel assemblies. The moment connections of this invention thus utilize steel encased in EPS foam and filled with concrete, and are believed to be particularly suited for resisting lateral and lift forces applied to the roof and/or walls of a building that tend to rip the roof off or cause the building to collapse. By way of example, such forces result from pressure differentials across the roof caused by the severe winds of a hurricane.

Figure 22:
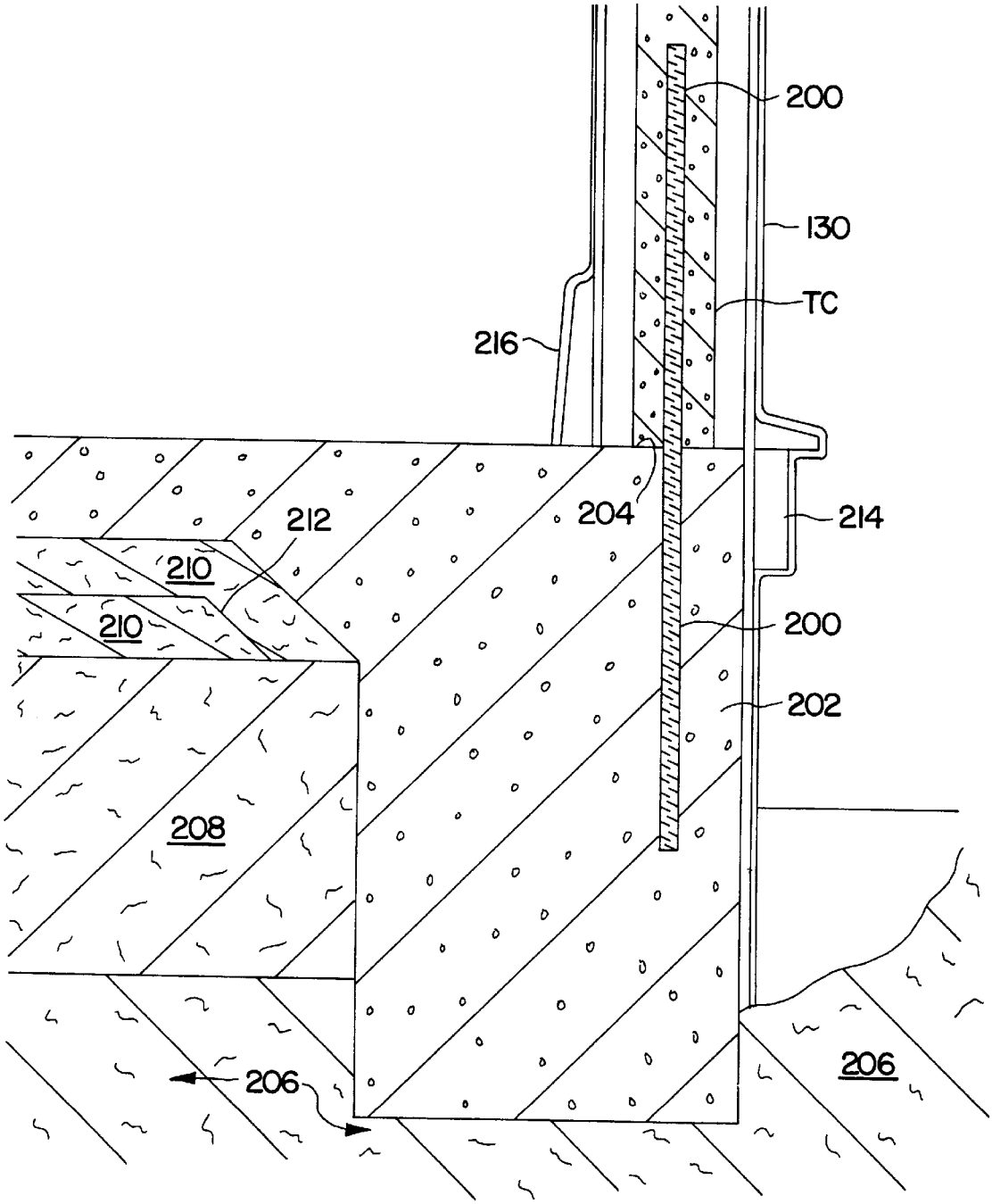
FIG. 22 is an elevational view, partially in section, of the connection between an external building wall and the building's foundation.

FIG. 22 displays a moment connection between exterior wall 130 of building 160 and the foundation beneath the building. A plurality of 36" #4 steel rebars are set within vertical tensile connectors TC that interconnect the wall panels of wall 130. Approximately half of each rebars' length extends through bottom track 204 into concrete slab 202 to firmly anchor the exterior walls of building 160 to the ground. To ensure proper anchoring of the walls, concrete slab 202 is poured much deeper about the perimeter of the foundation and is supported only by the ground soil in these areas. Slab 202 is otherwise supported by a suitable compacted fill material 208, and sand layers 210 separated by a VISQUEEN™ or equivalent moisture barrier. The exterior of the building is trimmed with continuous EPS trim 214 to prevent water intrusion between the concrete slab and the wall panels. Trim 214 may be hollow to function as a chase for plumbing conduit. EPS foam can also be shaped and applied as base molding 216 at the interface between the building floor and the inner wall surfaces.

To summarize the overall building process, building 160 is erected by first assembling the wall panels using the tensile connector of the present invention to form an independent vertical structure, as shown in FIG. 1A. The trusses that make up the roof subframe of FIG. 2A are next assembled over the wall panels, using hangers and lag bolts as necessary.

Figure 2B:
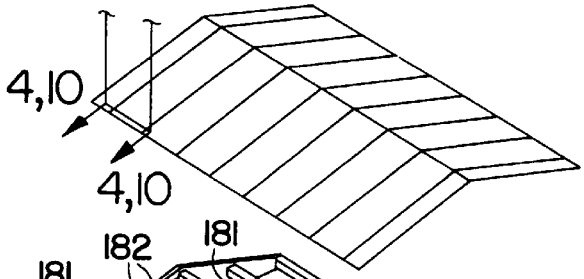
Figure 2A:
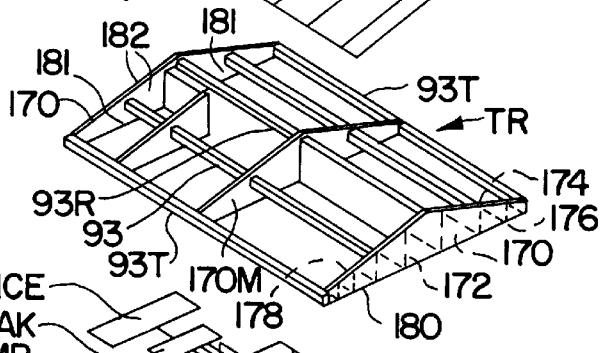

Once the roof subframe is in place, the EPS roof panels are assembled to one another over the roof subframe using tensile connectors, as indicated by FIG. 2B. The roof panels are fastened to the roof subframe using lag bolts and other means, as also shown in FIGS. 14 and 15, to form a complete assembly. Those skilled in the art will appreciate that the resulting roof assembly exhibits its own structural integrity independent from the wall assembly due to the use of the tensile connectors and the concrete within the connectors.

The roof panels may be coated with concrete on the bottom surfaces thereof at the shop to give them added strength for installation in the field. This prevents damage to the panels should installers walk across them when laying the panels over the roof subframe.

FIG. 2C illustrates the tile panel assembly that is attached over the roof panels in such fashion that the seams of the tiles do not overlie the seams of the panels. The building is completed with the application of cap strips, shown in FIG.

2D, over and between the seams in the tiles to provide an aesthetic appearance and additional weatherproofing for building 160.

Various door and window units (not shown) may be mounted in openings formed in building 160 either before or after the concrete application process. Aluminum, wood, or vinyl windows can be attached to the concrete with screws. Nevertheless, since the EPS panels have such a high insulating rating, extruded vinyl frames are preferable so as not to provide any type of significant conduction from outside the house to inside the house after windows are applied. Also, double-glazed windows are preferable because of the greater insulating effect they have. Appropriate ventilation holes can be provided under the eaves of the house (not shown) so that adequate air circulation is provided inside.

It will be apparent to those skilled in the art that the present invention will greatly ease the workload of building construction, as two workers can easily lift and set the panels into place. As described above, the panel assemblies will exhibit naturally strong joints, and the overall assembly demonstrates remarkable strength for its weight.

Those skilled in the art will further appreciate that the invention is useful for a myriad of building structures including new housing, retrofits for existing housing, as well as commercial, industrial, and institutional buildings. The present invention is also suitable for use in the construction of warehouses, theme parks, and movie and stage sets. Virtually any type of building component, whether load bearing or ornamental may be formed, including stairs, ramps, and decorative molding. The present invention is adaptable to multi-story structures as well as the single story building 160 described above.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

For example, the non-load bearing interior walls of building 160 can be framed in a more conventional manner by mounting bottom track to the building floor slab and top track to the ceiling panels for supporting vertical steel studs to which one inch thick sheets of EPS are hung using adhesive or other suitable means. The electrical service in these walls is installed between the studs in a conventional manner, before sheets of EPS are hung on both sides of the studs to fabricate the walls in place. Such walls are not filled with concrete, as they will not be subjected to external forces other than possibly the hanging of pictures, but the walls are coated on the exterior with concrete in the same manner as the other wall panel assemblies described above. Clearly, the use of this alternative interior wall structure complements building 160 as constructed in accordance with the present invention while simplifying the overall construction.

What is claimed is:

1. An assembly of composite building panels, comprising:

a pair of EPS panels each having a groove extending along an edge thereof; and a metal tensile connector connecting said panels; said tensile connector including:

metal tongue means anchored within the groove of one of the panels;

metal groove means anchored within the groove of the other panel;

means for locking said tongue means within said groove means to frame the tensile connector between the grooved edges of said panels whereby said panels are framed together; and concrete filling a void defined within said metal tongue and groove means when locked by said locking means to anchor said metal tongue means within said metal groove means and complete the connection between the grooved edges of said panels.

2. The assembly of claim 1 wherein said panels of EPS are coated with one or more layers of concrete.

3. The assembly of claim 1 wherein the grooved edges of said connected panels are 180° apart.

4. The apparatus of claim 1 wherein the grooved edges of said connected panels are 90° apart.

5. A tensile connector for connecting two panels of EPS each of which has a groove along an edge thereof, comprising:

metal tongue means for mounting within the grooved edge of one of the panels;

metal groove means for mounting within the grooved edge of the other panel;

means for locking said tongue means within said groove means for framing the tensile connector between the grooved edges of the panels; and concrete for filling a void defined within said metal tongue and groove means when locked by said locking means for anchoring said tongue means within said groove means and completing the connection between the grooved edges of said panels.

6. The tensile connector of claim 5 wherein said tongue means and said groove means each include a generally U-shaped metal stud having a closed end and an open end, the closed ends of said studs being adapted for mounting within the grooves in the edges of the panels.

7. The tensile connector of claim 6 wherein the open ends of each of said studs is bent inwardly to give said studs a generally C-shaped appearance, and said locking means comprises a metal spring clip attached to said tongue means locking the inwardly bent open ends of said studs to each other.

8. The tensile connector of claim 6 wherein said tongue means stud is of such length that its open end extends outwardly beyond the groove in the one panel once said tongue means stud is mounted therein, and said groove means stud is of such length that its open end extends outwardly within the groove in the other panel once said grooved means stud is mounted therein.

9. The tensile connector of claim 8 wherein the open end of said groove means stud is bent inwardly and the open end of said tongue means stud is bent outwardly more than 90° so that the outwardly bent open end of said tongue means stud will first be deformed inwardly and then snap back outwardly as it is slid and hooked within the inwardly bent open end of said groove means stud by the assembly of said studs for framing the tensile connector between the grooved edges of the panels.

10. A method of fabricating an assembly of two EPS panels each having a groove in one of its edges, comprising the steps of:

mounting a generally C-shaped metal stud within the groove in each panel using an adhesive, the studs being shaped to approximate the shape of the respective grooves and having inwardly bent open ends that face outwardly from the grooves;

attaching a metal connecting clip to one of the studs in engagement with the inwardly bent end of the one stud;

assembling the grooved edges of the panels together so that the connecting clip engages the inwardly bent end of the other stud, whereby the inwardly bent ends of the studs are locked together to frame a tensile connector between the panels; and filling the framed tensile connector with concrete to complete the connection between the panels.

11. An assembly of composite building panels suitable for constructing the floors, walls, ceiling, and roof of a building, comprising:

a plurality of substantially rectangular EPS panels aligned edge-to-edge, the edges of adjacent panels opposing one another and having complementary grooves therein; and a connector connecting the opposing edges of adjacent panels, said connector including:

metal tongue means attached to one of the complementary grooves;

metal groove means attached to the other complementary groove, said tongue means interlocking with said groove means when the opposing edges of adjacent panels are brought together to frame said connector between adjacent panels; and a cementitious composite filling a void defined within said metal tongue and groove means when locked by said locking means to complete the connection of adjacent panels, said connector being encased within the complementary groove of the EPS panels.

12. The assembly of claim 11 wherein one of said grooved panels includes a further groove adjacent the encased tensile connector for running electrical conduit.

13. The assembly of claim 11, wherein said groove means includes a metal stud having a pair of open ends that are bent inwardly at substantially a right angle, and said tongue means includes a metal stud having a pair of open ends that are bent inwardly at substantially a right angle, and a spring clip having opposing side walls that are yieldably separated by a spring stiffness of the clip and contain recessed areas receiving the respective inwardly bent open ends of the metal studs when said tongue means and said groove means are brought together, the side walls of the spring clip being initially deformed inwardly by engagement with the inwardly bent ends as said tongue means and said groove means are brought together and then returned under the spring stiffness of the clip when the ends are disposed in the respective recesses of the side walls to complete the connection.

14. The assembly of claim 11, further comprising an outer coating of said cementitious composite applied directly to said EPS panels to form a composite coated assembly.

15. The assembly of claim 14, wherein said outer coating is applied to said EPS panels by spraying said cementitious composite.

16. The assembly of claim 15, wherein said cementitious composite comprises Portland cement, silica, polypropylene fibers, water, and calcareous aggregate of varying size ranging from powder to 0.1", the amount of calcareous aggregate in the mixture being 100–130% by weight of the amount of Portland cement in the mixture.

17. The assembly of claim 15, wherein said cementitious composite comprises solids in the amount of:

(a) 30–45% by weight of silica;

(b) 5–15% by weight of silicates sized to pass an ASTM standard No. 4-sized mesh screen;

(c) 20–30% by weight of marble aggregate of varying size ranging from powder up to 0.1";

(d) 20–25% by weight of Portland cement;

(e) 0–10% by weight of lime; and (f) 0–1% by weight of polypropylene monofilament fibers; and said cementitious composite further includes sufficient water to form a sprayable concrete mixture.

18. The assembly of claim 17, wherein said cementitious composite further includes vinyl acrylic polymer fortifier of a volume not more than the volume of water.

19. An assembly of EPS panels for forming the walls, ceilings, and roof of a building comprising a plurality of EPS panels arranged with their edges abutting, each edge having a groove extending along its abutting edge, a metal stud, U-shaped in cross-section, mounted in each groove with their open ends facing, a spring clip in each stud engaging when the panels are moved into end-to-end abutting position to lock the panels together, and a volume of cementitious grout filling a void between the studs, and the clips and between the clips to form a joint between the panels.

* * * * *